US009099049B2

(12) United States Patent
Jung et al.

(10) Patent No.: US 9,099,049 B2
(45) **Date of Patent: *Aug. 4, 2015**

(54) METHOD OF DIMMING BACKLIGHT ASSEMBLY

(71) Applicant: SAMSUNG DISPLAY CO., LTD., Yongin, Gyeonggi-do (KR)

(72) Inventors: Tae Kwon Jung, Asan-si (KR); Dongmin Yeo, Asan-si (KR); Byungchoon Yang, Seoul (KR); Yong-Hoon Kwon, Asan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/094,153

(22) Filed: Dec. 2, 2013

(65) Prior Publication Data

US 2014/0085351 A1 Mar. 27, 2014

Related U.S. Application Data

(63) Continuation of application No. 12/969,809, filed on Dec. 16, 2010, now Pat. No. 8,599,225.

(30) Foreign Application Priority Data

Mar. 22, 2010 (KR) ..... 10-2010-0025441

(51) Int. Cl.
*G09G 3/36* (2006.01)
*G09G 3/34* (2006.01)

(52) U.S. Cl.
CPC ..... *G09G 3/3607* (2013.01); *G09G 3/3426* (2013.01); *G09G 3/3413* (2013.01); *G09G 2320/0626* (2013.01); *G09G 2360/16* (2013.01)

(58) Field of Classification Search
CPC ..... G09G 2320/0626; G09G 2360/16; G09G 3/3413; G09G 3/3426; G09G 3/3607; H04N 9/67; H04N 1/54
USPC ..... 345/82, 87, 90, 102, 690
See application file for complete search history.

(56) References Cited

U.S. PATENT DOCUMENTS 7,609,244 B2 * 10/2009 Kim et al. ..... 345/89
2006/0167784 A1 * 7/2006 Hoffberg ..... 705/37

(Continued)

FOREIGN PATENT DOCUMENTS

KR 10-2009-0081804 7/2009

OTHER PUBLICATIONS

English Abstract for Publication No. 10-2009-0081804.

*Primary Examiner* — Amare Mengistu
*Assistant Examiner* — Gloryvid Figueroa-Gibson
(74) *Attorney, Agent, or Firm* — F. Chau & Associates, LLC

(57) ABSTRACT

A plurality of gray-scale values is extracted from image signals corresponding to a dimming area to calculate a mean value of the gray-scale values, and at least one of a variance, a standard deviation, a kurtosis, a skewness, a central moment, and an image moment is calculated using the mean value. Then, a representative gray-scale value corresponding to the dimming area is determined using the calculated values, and a dimming function for the light sources included in the dimming area is determined based on the representative gray-scale value. Then, the light sources included in the dimming area are driven based on the dimming function.

17 Claims, 5 Drawing Sheets

(56) References Cited

U.S. PATENT DOCUMENTS

2007/0001997 A1* 1/2007 Kim et al. ..... 345/102
2008/0247663 A1* 10/2008 Jacobsen ..... 382/266
2009/0189543 A1* 7/2009 Yeo et al. ..... 315/297
2011/0134358 A1* 6/2011 Wasinger et al. ..... 349/61
2011/0279749 A1* 11/2011 Erinjippurath et al. ..... 349/61
2012/0238009 A1* 9/2012 Greenbaum et al. ..... 435/288.7

* cited by examiner

METHOD OF DIMMING BACKLIGHT ASSEMBLY

CROSS-REFERENCE TO RELATED APPLICATION

This application is a continuation of, and claims priority from U.S. application Ser. No. 12/969,809, filed on Dec. 16, 2010 in the U.S. Patent and Trademark Office, which in turn claims priority under 35 U.S.C. §119 from Korean Patent Application No. 10-2010-0025441 filed on Mar. 22, 2010 in the Korean Intellectual Property Office (KIPO), the contents of which are herein incorporated by reference in their entirety.

BACKGROUND

1. Field of the Invention

The present disclosure is directed to a method of dimming a backlight assembly. More particularly, the present disclosure is directed to a method of dimming a backlight assembly including controlling a dimming function of light sources divided into at least one dimming area.

2. Description of the Related Art

A liquid crystal display includes a liquid crystal display panel and a backlight unit. The liquid crystal display includes a first substrate, a second substrate, and a liquid crystal layer interposed between the first and second substrates. The liquid crystal molecules of the liquid crystal layer that transmit light from the backlight unit are aligned by an electric field and light transmittance of the liquid crystal layer depends upon the arrangement of the liquid crystal molecules. The liquid crystal display panel displays a white image having relatively high brightness when the transmittance of the liquid crystal layer is relatively high, and displays a black image having relatively low brightness when the transmittance of the liquid crystal layer is relatively low.

In general, however, the liquid crystal molecules of the liquid crystal layer do not perfectly align, so light leakage occurs in the liquid crystal display panel for low gray-scale values. That is, although a liquid crystal display panel can display an image at low gray-scale values, the liquid crystal display panel may not display a black image due to light leakage when the backlight unit provides a high intensity light to the liquid crystal display panel. Accordingly, light leakage reduces the contrast ratio of the image displayed on the liquid crystal display panel. In addition, in view of energy utilization efficiency, it is inefficient to consume more energy to increase light intensity and then block the light in the liquid crystal display panel.

SUMMARY

Exemplary embodiments of the present invention provide a method of dimming a backlight assembly, which includes dimming a plurality of light sources based on characteristics of the images being displayed on a liquid crystal display panel.

According to an exemplary embodiment of the invention, a method of dimming a backlight assembly comprising a plurality of light sources divided into at least one dimming area using image signals provided to a display panel is as follows.

A plurality of gray-scale values is extracted from image signals corresponding to a dimming area to calculate a mean value of the gray-scale values, and at least one of a variance, a standard deviation, a kurtosis, a skewness, a central moment, and an image moment is calculated using the mean value.

Then, a representative gray-scale value corresponding to the dimming area is determined using the calculated values, and a dimming function for the light sources included in the dimming area is determined based on the representative gray-scale value to drive the light sources included in the dimming area.

The method according to an embodiment of the invention may further comprise calculating a minimum value or a maximum value of the gray-scale values.

According to the above, the representative gray-scale value for the dimming area may be determined by using the mean value, the maximum value, the minimum value, the variance, the standard deviation, the kurtosis, the skewness, the central moment, and an image moment, the dimming function for the light sources in the dimming area may be determined based on the representative gray-scale value, and the light sources in the dimming area may be driven based on the dimming function. Thus, the contrast ratio of the images displayed in the display panel may be improved, thereby improving display quality and reducing power consumption in the display panel.

DETAILED DESCRIPTION OF EXEMPLARY EMBODIMENTS

It will be understood that when an element or layer is referred to as being "on", "connected to" or "coupled to" another element or layer, it can be directly on, connected or coupled to the other element or layer or intervening elements or layers may be present. Like numbers may refer to like elements throughout.

Hereinafter, exemplary embodiments of present invention will be explained in detail with reference to the accompanying drawings.

Figure 1:
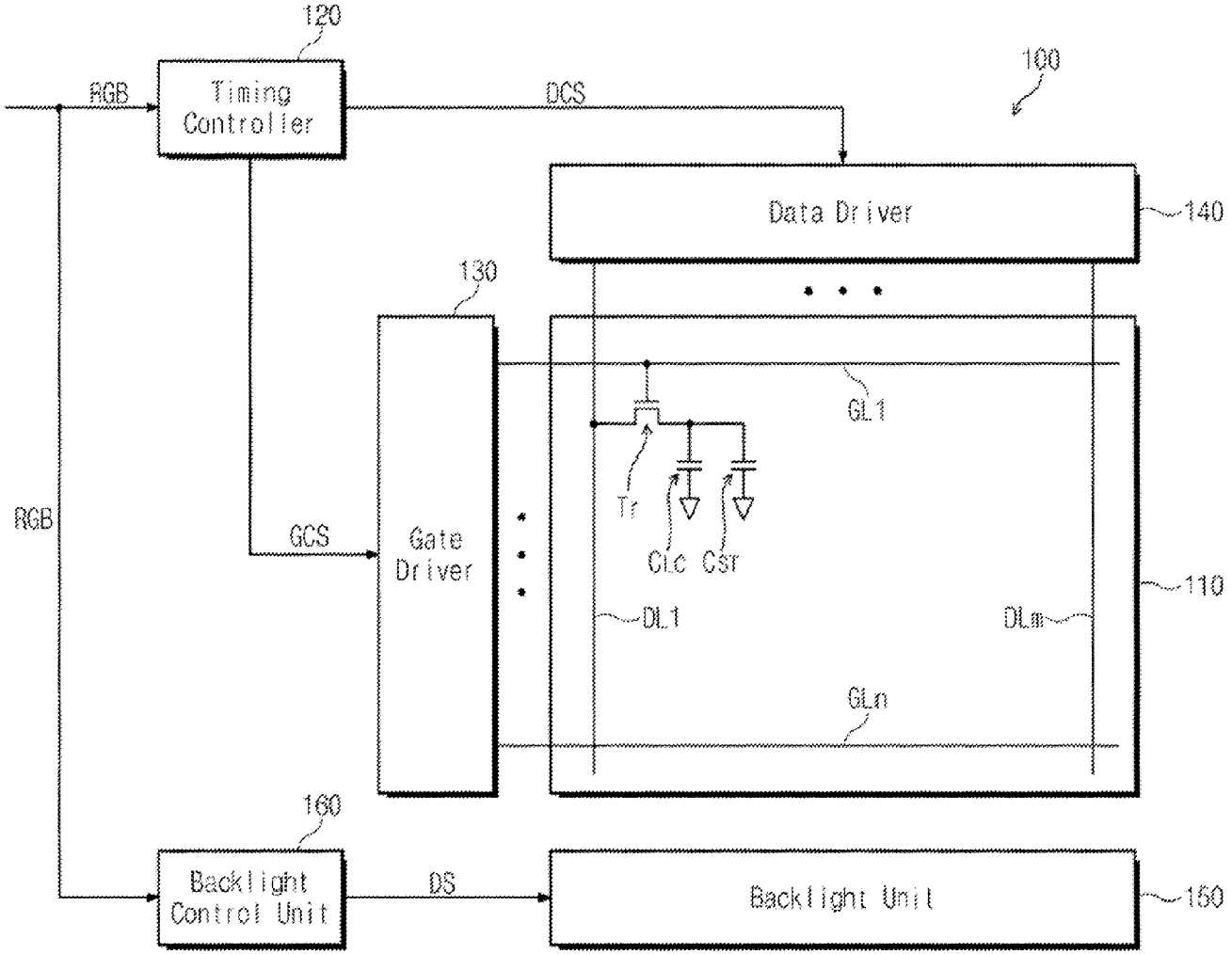
FIG. 1 is a block diagram showing a liquid crystal display according to an exemplary embodiment of the present invention.

FIG. 1 is a block diagram showing a liquid crystal display according to an exemplary embodiment of the present invention.

Referring to FIG. 1, a liquid crystal display 100 includes a liquid crystal display panel 110, a timing controller 120, a gate driver 130, a data driver 140, a backlight unit 150, and a backlight control circuit 160.

The timing controller 120 receives image signals RGB from an external device (not shown). The timing controller 120 converts a data format of the image signals RGB into a data format appropriate to an interface between the timing controller 120 and the data driver 140 and outputs the converted image signals RGB to the data driver 140 as a data control signal DCS. In addition, the timing controller 120 outputs a gate control signal GCS to the gate driver 130.

The gate driver 130 sequentially applies a gate signal to gate lines GL1~GLn of the liquid crystal display panel 110 in response to the gate control signal GCS from the timing controller 120 to sequentially scan the gate lines GL1~GLn.

The data driver 140 generates a plurality of gray-scale voltages using gamma voltages provided from a gamma voltage generator (not shown). From the generated gray-scale voltages, the data driver 140 selects gray-scale voltages that correspond to the image signals RGB in response to the data control signal DCS and applies the selected gray-scale voltages to data lines DL1~DLm of the liquid crystal display panel 110 as a data signal.

The liquid crystal display panel 110 includes the gate lines GL1~GLn, the data lines DL1~DLm crossing the gate lines GL1~GLn, and a plurality of pixels.

Since the pixels have the same structure and function, for the convenience of explanation, one pixel has been shown in FIG. 1 as a representative example. Each pixel includes a thin film transistor Tr including a gate electrode connected to a corresponding gate line of the gate lines GL1~GLn and a source electrode connected to a corresponding data line of the data lines DL1~DLm, a liquid crystal capacitor $C_{LC}$ connected to a drain electrode of the thin film transistor Tr, and a storage capacitor $C_{ST}$ connected to the drain electrode of the thin film transistor When the gate signal is sequentially applied to the gate lines GL1~GLn, the data signal is applied to the data lines DL1~DLm. When the gate signal is applied to the corresponding gate line, the thin film transistor Tr connected to the corresponding gate line is turned on in response to the gate signal. Then, the data signal applied to the data line connected to the turned-on thin film transistor Tr is charged into the liquid crystal capacitor $C_{LC}$ and the storage capacitor $C_{ST}$ through the turned-on thin film transistor Tr.

The liquid crystal capacitor $C_{LC}$ controls the light transmittance of liquid crystal molecules of a liquid crystal layer according to the charged voltage therein. The storage capacitor $C_{ST}$ stores the data signal therein during the turned-on period of the thin film transistor Tr and, when the thin film transistor Tr is turned off, applies the stored data signal to the liquid crystal capacitor $C_{LC}$ to maintain the liquid crystal capacitor $C_{LC}$ in the charged state. Thus, the liquid crystal display panel 110 may display the image thereon.

The backlight control circuit 160 outputs a dimming signal DS to the backlight unit 150 based on the image signal RGB to drive the backlight unit 150.

The backlight unit 150 is disposed adjacent to the liquid crystal display panel 110 to provide the liquid crystal display panel 110 with light. The backlight unit 150 includes a plurality of light sources (not shown) and drives the light sources in response to the dimming signal DS from the backlight control circuit 160. Various types of light sources may be used, such as a cold cathode fluorescent lamp, an external electrode fluorescent lamp, a light emitting diode, etc.

Figure 2:
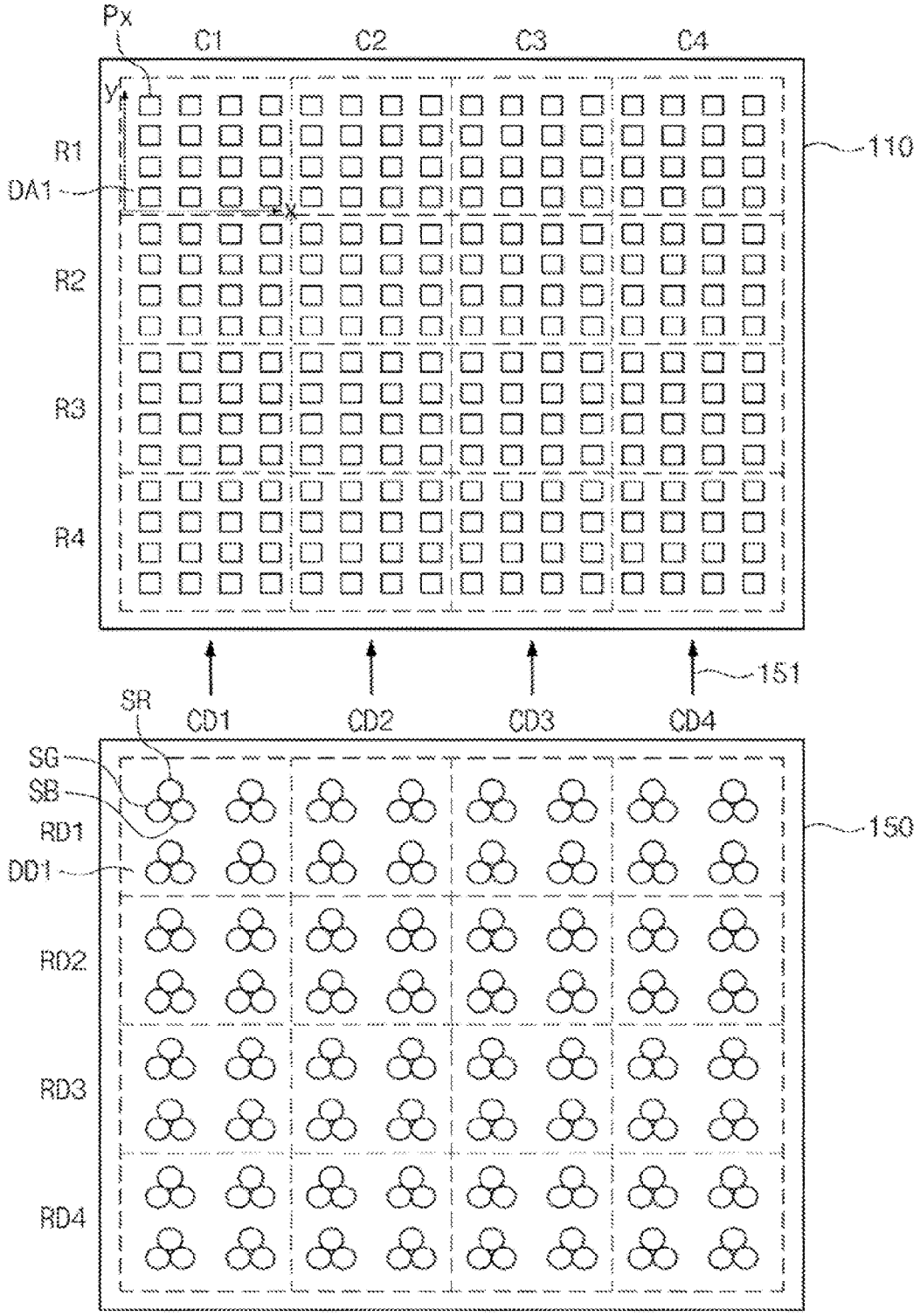
FIG. 2 is a plan view showing a liquid crystal display panel and a backlight unit of FIG. 1.

FIG. 2 is a plan view showing a liquid crystal display panel and a backlight unit of FIG. 1.

Referring to FIG. 2, the backlight unit 150 may include light sources emitting black or white and/or emitting various colors. In FIG. 2, light sources $S_R$, $S_G$, and $S_B$ each emitting red, green, and blue light, respectively, have been shown as an example.

The light sources $S_R$, $S_G$, and $S_B$ may be divided and arranged in 16 dimming areas RD1:CD1 to RD4:CD4 including four rows RD1 to RD4 and four columns CD1 to CD4. In the backlight unit 150 according to the present exemplary embodiment, the light sources arranged in one dimming area may be independently operated from one another. For example, the light sources arranged in a first dimming area RD1:CD1 (hereinafter, referred to as DD1) corresponding to a first row and a first column may be independently operated from the light sources arranged in other dimming areas, e.g., a second dimming area RD1:CD2. In addition, the light sources $S_R$, $S_G$, and $S_B$ arranged in the same dimming area may be independently operated from each other based on their color.

The pixels Px in the liquid crystal display panel 110 are also arranged in 16 display areas R1:C1 to R4:C4 including four rows R1 to R4 and four columns C1 to C4 corresponding to the dimming areas RD1:CD1 to RD4:CD4. The display areas R1:C1 to R4:C4 are virtual areas respectively corresponding to the dimming areas RD1:CD1 to RD4:CD4 of the backlight unit 150. Accordingly, the pixels Px may be dependently or independently operated from each other.

In the present exemplary embodiment, the dimming areas RD1:CD1 to RD4:CD4 and the display areas R1:C1 to R4:C4 are divided into 16 areas, but they should not be limited thereto or thereby. Other arrangements with more or fewer columns, rows, and dimming areas are within the scope of embodiments of the invention. In addition, although FIG. 2 depicts four groups of red, green, and blue light sources $S_R$, $S_G$, $S_B$ within each dimming area, and sixteen pixels Px within each display area, these numbers are exemplary and non-limiting. Dimming areas with differing numbers of light sources, and display areas with differing numbers of pixels, are within the scope of various other embodiments of the invention.

The pixels Px display the image based on the gray-scale values included in the image signals RGB applied to the liquid crystal display panel 110. According to an embodiment of the invention, the gray-scale values may be 8 bit integers that range from 0 to 255 in value.

The light sources included in each dimming area have the same structure and function and the pixels included in each display area have the same structure and function, thus the first dimming area DD1 and the first display area R1:C1 (hereinafter, referred to as DA1) will each be described as a representative example.

Figure 3:
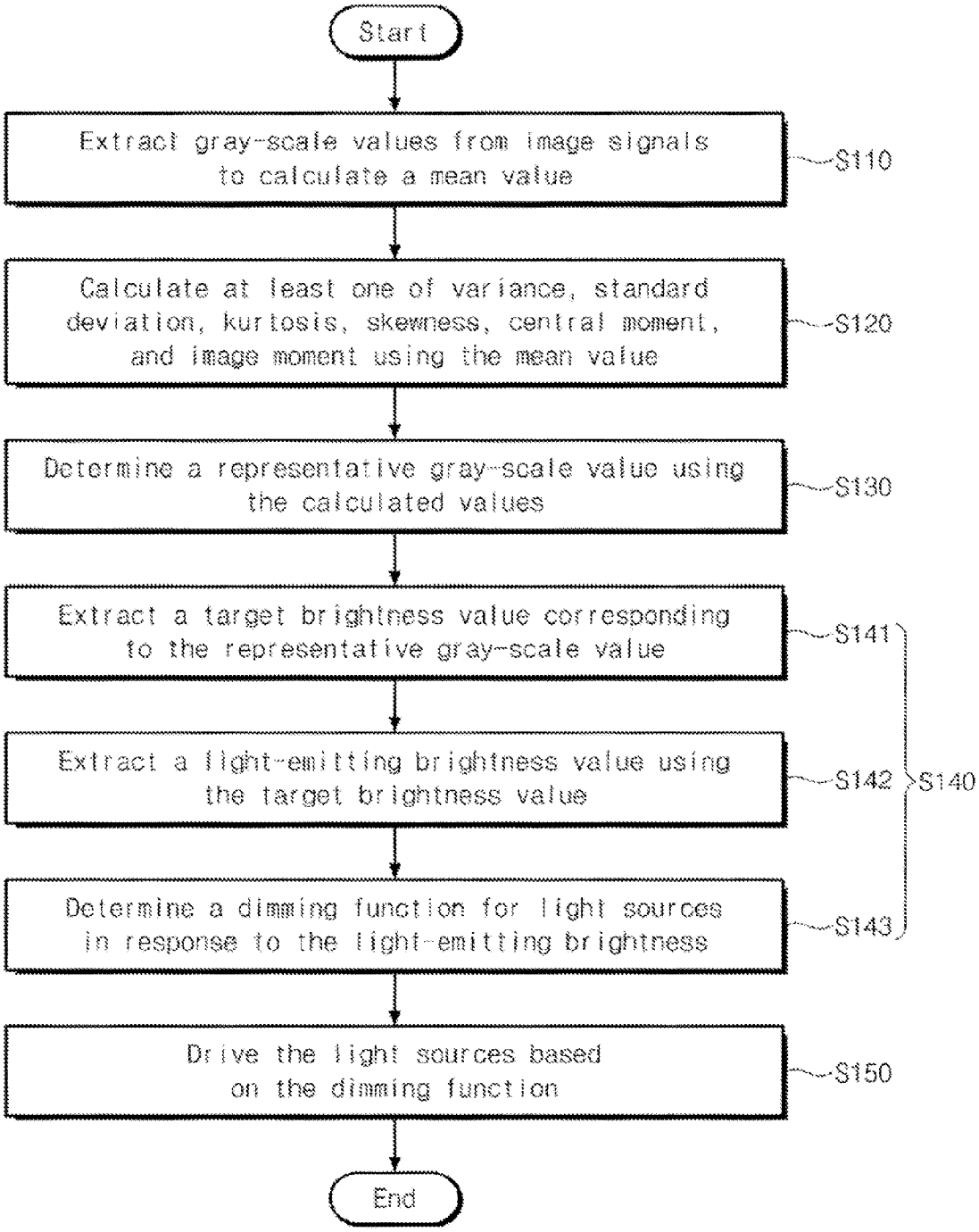
FIG. 3 is a flow chart showing a method of controlling a backlight control circuit of FIG. 1.

FIG. 3 is a flow chart showing a method of controlling a backlight control circuit of FIG. 1.

Referring to FIG. 3, the backlight control circuit 160 extracts gray-scale values GRV from the image signals RGB corresponding to the first display area DA1 among the image signals RGB and calculates a mean value (in) of the gray-scale values GRV (S110). In this case, the mean (m) may be defined by the following functional formula 1.

$$m = \frac{1}{n}\sum_{i=1}^{n} I_i \qquad \text{Functional formula 1}$$

In Functional formula 1, n denotes a number of data values and $I_i$ denotes an i-th gray-scale value of the gray-scale values GRV. Then, at least one value from among the variance ($\sigma^2$), standard deviation ($\sigma$), kurtosis ($\gamma_1$), skewness ($\gamma_2$), and central moment ($\mu_k$) is calculated (S120). The variance ($\sigma^2$), standard deviation ($\sigma$), kurtosis ($\gamma_1$), skewness ($\gamma_2$), and k-th central moment ($\mu_k$) may be defined by the following functional formulae.

$$\sigma^2 = \frac{1}{n}\sum_{i=1}^{n} (I_i - m)^2 \qquad \text{Functional formula 2}$$

$$\sigma = \sqrt{\frac{1}{n}\sum_{i=1}^{n} (I_i - m)^2} \qquad \text{Functional formula 3}$$

-continued $$\gamma_1 = \frac{\frac{1}{n}\sum_{i=1}^{n}(I_i - m)^3}{\left(\frac{1}{n}\sum_{i=1}^{n}(I_i - m)^2\right)^{\frac{3}{2}}}$$ Functional formula 4

$$\gamma_2 = \frac{\frac{1}{n}\sum_{i=1}^{n}(I_i - m)^4}{\left(\frac{1}{n}\sum_{i=1}^{n}(I_i - m)^2\right)^{2}} - 3$$ Functional formula 5

$$\mu_k = \frac{1}{n}\sum_{i=1}^{n}(I_i - m)^k$$ Functional formula 6

FIGS. 4A to 4H are views showing eight images capable of being displayed on one dimming area.

Figure 4A:
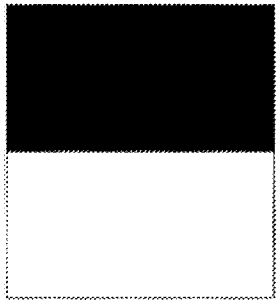
FIGS. 4A to 4H are views showing eight images capable of being displayed on one dimming area.

Referring to FIGS. 4A to 4H, the mean value, the standard deviation, kurtosis, and skewness of the gray-scale values obtained from the image in FIG. 4A, for example, 12.5, 127.5, 0.0, and −2.0, respectively, are the same as those obtained from each image shown in FIGS. 4B to 4H. Accordingly, values other than the above-mentioned values are required to discriminate the images from each other in FIGS. 4A to 4H. Table 1 shows image moment values calculated based on the images in FIGS. 4A to 4H. Details of how these image moment values are calculated will be provided below. As shown in Table 1, some of the image moment values calculated from the images in FIGS. 4A to 4H are different. Thus, images having the same mean, standard deviation, kurtosis, and skewness may be discriminated from each other by using the image moment values.

TABLE 1

Figure 4B:
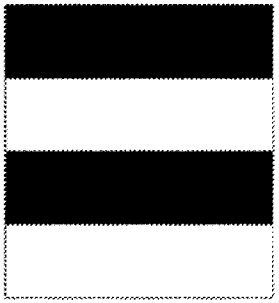
Figure 4C:
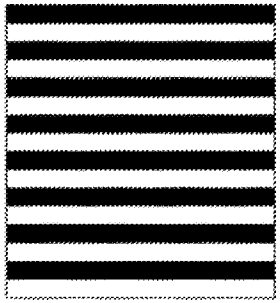
Figure 4D:
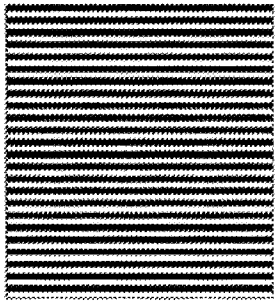
Figure 4E:
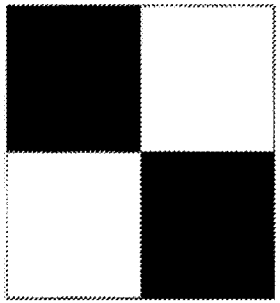
Figure 4F:
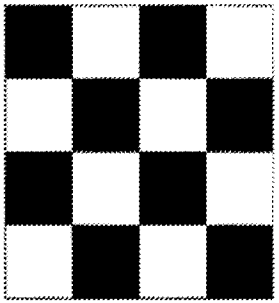
Figure 4G:
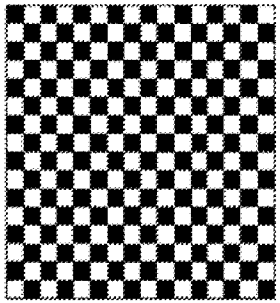
Figure 4H:
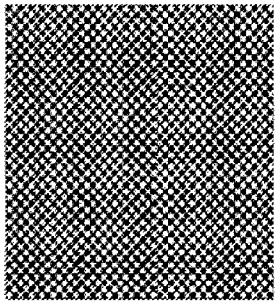

| | $\lvert\bar{x}\rvert$ | $\lvert\bar{y}\rvert$ | $\sqrt{\lvert\mu_{11}\rvert}$ | $\sqrt{\lvert\mu_{20}\rvert}$ | $\sqrt{\lvert\mu_{02}\rvert}$ | $\sqrt[3]{\lvert\mu_{21}\rvert}$ | $\sqrt[3]{\lvert\mu_{12}\rvert}$ | $\sqrt[3]{\lvert\mu_{30}\rvert}$ | $\sqrt[3]{\lvert\mu_{03}\rvert}$ |
|---|---|---|---|---|---|---|---|---|---|
| FIG. 4A | 16 | 0 | 0 | 9.23 | 18.47 | 0 | 0 | 0 | 0 |
| FIG. 4B | 8 | 0 | 0 | 16.65 | 18.47 | 0 | 0 | 0 | 0 |
| FIG. 4C | 2 | 0 | 0 | 18.36 | 18.47 | 0 | 0 | 0 | 0 |
| FIG. 4D | 0.5 | 0 | 0 | 18.47 | 18.47 | 0 | 0 | 0 | 0 |
| FIG. 4E | 0 | 0 | 16 | 18.47 | 18.47 | 0 | 0 | 0 | 0 |
| FIG. 4F | 0 | 0 | 8 | 18.47 | 18.47 | 0 | 0 | 0 | 0 |
| FIG. 4G | 0 | 0 | 2 | 18.47 | 18.47 | 0 | 0 | 0 | 0 |
| FIG. 4H | 0 | 0 | 0.5 | 18.47 | 18.47 | 0 | 0 | 0 | 0 |

Accordingly, the image moment values may be further calculated using the mean value m. In this case, the image moment values include information about positions of the pixels representing the gray-scale values GRV.

Thus, when referring to FIG. 2, an x-axis and a y-axis perpendicular to the x-axis are set in each of the display areas R1:C1 to R4:C4 to indicate the positions of the pixels Px in the display areas R1:C1 to R4:C4. For example, in the case of the first display area DA1, an origin of each of the x-axis and the y-axis corresponding to the first display area DA1 may be located at a point inside or around the first display area DA1. In FIG. 2, a point adjacent to a left-lower vertex of the first display area DA1 has been selected as the origin of each of the x-axis and the y-axis.

The image moment values may include a raw image moment $M_{pg}$ and a central image moment $\mu_{pg}$ defined by the following functional formulae. When the number of the gray-scale values GRV extracted from the image signals RGB corresponding to the first display area DA1 is n (n is a constant number equal to or greater than 2), an image moment of the n-th degree or lower may be calculated.

$$M_{pq} = \sum_x \sum_y x^p y^q I(x, y)$$ Functional formula 7

In Functional formula 7, x denotes an x-axis position of a pixel measured with respect to the origin, y denotes the y-axis position of the pixel measured with respect to the origin, and I(x,y) denotes a gray-scale value of the pixel positioned at that position.

$$\mu_{pq} = \sum_x \sum_y (x - \bar{x})^p (y - \bar{y})^q I(x, y)$$ Functional formula 8

In Functional formula 8, $\bar{x}$ denotes an x-axis average raw image moment and $\bar{y}$ denotes a y-axis average raw image moment, and they are defined by the following functional formulae.

$$\bar{x} = \frac{M_{10}}{M_{00}}$$ Functional formula 9

$$\bar{y} = \frac{M_{01}}{M_{00}}$$ Functional formula 10

In addition, a minimum value Pn or a maximum value P of the gray-scale values GRV may be further calculated from the gray-scale values GRV.

Then, referring back to FIG. 3, a representative gray-scale value GRE of the first display area DA1 is calculated from the above-calculated values m, P, Pn, $\sigma^2$, $\sigma$, $\gamma_1$, $\gamma_2$, $M_{pg}$, and $\mu_{pg}$ (hereinafter, referred to as reference values REV) (S130). The representative gray-scale value GRE may be a function of first or second degree or higher of the reference values REV and may include a log or an exponential function of the reference values REV.

In particular, a negative (−) kurtosis $\gamma_1$ value means that the gray-scale values GRV include more values greater than the mean value (m) than values less than the mean value (m). On the contrary, a positive (+) kurtosis $\gamma_1$ value means that the gray-scale values GRV include more values less than the mean value (m) than values greater than the mean value (m). In addition, a skewness $\gamma_2$ value of zero (0) means that the gray-scale values GRV are normally distributed, a negative (−) skewness $\gamma_2$ value means that the gray-scale values GRV are more uniformly distributed than the normal distribution, and a positive (+) skewness $\gamma_2$ value means that the gray-scale values GRV are more closely distributed around the mean value than in the normal distribution.

Accordingly, as an example to calculate the representative gray-scale value GRE, the representative gray-scale GRE may be calculated by applying a larger weight to the mean value (m) when the kurtosis $\gamma_1$ is positive (+) or by applying a larger weight to the maximum value P when the kurtosis $\gamma_1$ is negative (−). This is because, when the skewness $\gamma_2$ of the gray-scale values GRV is negative (−) and an absolute value of the kurtosis $\gamma_1$ is relatively large, values either greater than the mean value (m) or less than the mean value (m) are relatively frequent even though the gray-scale values GRV are generally uniformly distributed. In addition, in case that the skewness $\gamma_2$ of the gray-scale values GRV is negative (−) and the absolute value of the kurtosis $\gamma_1$ is relatively small, the representative gray-scale value GRE may be selected by applying a larger weight to the mean value (m) because the gray-scale values GRV are generally uniformly distributed and gray-scale values each either greater than or less than the mean value (m) are symmetrically distributed with reference to the mean value (m).

Similarly, a representative gray-scale GRE may be calculated by applying a larger weight to the mean value (m) when the kurtosis $\gamma_1$ is positive (+) or by applying a larger weight to the maximum value P when the kurtosis $\gamma_1$ is negative (−). This is because, when the skewness $\gamma_2$ of the gray-scale values GRV is positive (+) and an absolute value of the kurtosis $\gamma_1$ is relatively large, the values each either greater than the mean value (m) or less than the mean value (m) are relatively frequent and the gray-scale values GRV are more closely distributed around the mean value (m). In addition, in case that the skewness $\gamma_2$ of the gray-scale values GRV is positive (+) and the absolute value of the kurtosis $\gamma_1$ is relatively small, the representative gray-scale value GRE may be selected by applying a larger weight to the mean value (m) because the gray-scale values GRV are generally uniformly and symmetrically distributed around the mean value (m).

Hereinafter, examples of a process according to an embodiment of the invention of calculating the representative gray-scale value GRE by using the reference values REV will be described as follows.

Example 1

$$\gamma_2 \geq 0, GRE = \alpha \times m + (1-\alpha) \times P,$$

$$\gamma_2 < 0, GRE = \alpha \times m + (1-\alpha) \times P - \beta\gamma_1.$$

In Example 1, in denotes the mean value, P denotes the maximum value, $\gamma_1$ denotes the kurtosis, $\gamma_2$ denotes the skewness, $$\alpha = \frac{1}{C+K}$$

and β are predetermined experimental constants. C is a predetermined constant satisfying the condition $0.5 \leq C \leq 1.5$. If $\mathrm{Max}(\sqrt{|\mu_{20}|}, \sqrt{|\mu_{02}|}, \sqrt[3]{|\mu_{12}|}, \sqrt[3]{|\mu_{21}|}, \sqrt[3]{|\mu_{30}|}, \sqrt[3]{|\mu_{03}|}) \geq T$, K is $\mathrm{Max}(|\bar{x}|, |\bar{y}|, \sqrt{|\mu_{11}|})$. If $\mathrm{Max}(\sqrt{|\mu_{20}|}, \sqrt{|\mu_{02}|}, \sqrt[3]{|\mu_{12}|}, \sqrt[3]{|\mu_{21}|}, \sqrt[3]{|\mu_{30}|}, \sqrt[3]{|\mu_{03}|}) < T$, K is zero (0). In this case, T denotes a predetermined experimental threshold value, $\bar{x}$ denotes the x-axis average raw image moment of the gray-scale values, $\bar{y}$ denotes the y-axis average raw image moment of the gray-scale values, and $\mu_{ij}$ denotes the central image moment of the i-th degree along the x-axis and of the j-th degree along the y-axis.

$$\gamma_1 \geq 0,\ GRE = m - K\frac{\sigma + \gamma_2}{2},$$

$$\gamma_1 < 0,\ GRE = m + K\frac{\sigma + \gamma_2}{2}.$$

Example 2

In Example 2, m denotes the mean value, σ denotes variance, $\gamma_1$ denotes the kurtosis, $\gamma_2$ denotes the skewness, and K is a predetermined constant satisfying the condition K>0.

$$GRE = \alpha_1 m + \alpha_2 \sigma + \alpha_3 \gamma_1 + \alpha_4 \gamma_2 + \alpha_5 P + \alpha_6 \bar{x} + \alpha_7 \bar{y} + \alpha_8 \sqrt{|\mu_{11}|} + \alpha_9 \sqrt{|\mu_{20}|} + \alpha_{10} \sqrt{|\mu_{02}|} + \alpha_{11} \sqrt[3]{|\mu_{12}|} + \alpha_{12} \sqrt[3]{|\mu_{21}|} + \alpha_{13} \sqrt[3]{|\mu_{30}|} + \alpha_{14} \sqrt[3]{|\mu_{03}|}.$$

Example 3

In Example 3, in denotes the mean value, σ denotes the variance, P denotes the maximum value, $\gamma_1$ denotes the kurtosis, $\gamma_2$ denotes the skewness, $\bar{x}$ denotes the x-axis average raw image moment of the gray-scale values, $\bar{y}$ denotes the y-axis average raw image moment of the gray-scale values, and $\mu_{ij}$ denotes the central image moment of the i-th degree along the x-axis and of the j-th degree along the y-axis. In addition, if $\alpha_1+\alpha_2+\alpha_3+\alpha_4+\alpha_5+\alpha_6+\alpha_7+\alpha_8+\alpha_9+\alpha_{10}+\alpha_{11}+\alpha_{12}+\alpha_{13}+\alpha_{14}$ is 1, then each $\alpha_1$ is greater than or equal to zero (0) and less than or equal to one (1) ($0 \leq \alpha_i \leq 1$).

Example 4

$$A \leq T_1, GRE = m$$

$$A \geq T_2, GRE = P$$

When assuming that A is greater than $T_1$ and less than $T_2$ ($T_1 < A < T_2$), if the kurtosis $\gamma_1$ is greater than zero ($\gamma_1 > 0$), the representative gray-scale value GRE satisfies a condition $\alpha \times m + (1-\alpha) \times P$, i.e., $GRE = \alpha \times m + (1-\alpha) \times P$, and if kurtosis $\gamma_1$ is equal to or less than zero ($\gamma_1 \leq 0$) the representative gray-scale value GRE satisfies a condition $(1-\beta) \times m + \beta \times P$, i.e., $GRE = (1-\beta) \times m + \beta \times P$.

In Example 4, $A = |\bar{x}| + |\bar{y}| + \sqrt{|\mu_{11}|}$, $\bar{x}$ denotes the x-axis average raw image moment of the gray-scale values, $\bar{y}$ denotes the y-axis average raw image moment of the gray-scale values, $\mu_{ij}$ denotes the central image moment of the i-th degree along the x-axis and of the j-th degree along the y-axis, m denotes the mean value, P denotes the maximum value, $\gamma_1$ denotes the kurtosis, $T_1$ and $T_2$ are predetermined experimental threshold values, $\alpha = K\gamma_1\gamma_2$, $\beta = -K\gamma_1\gamma_2$, K denotes a predetermined experimental constant, and $\gamma_2$ denotes the skewness.

Then, again referring back to FIG. 3, when the representative gray-scale value GRE is selected, the dimming function DDD of the light sources included in the first dimming area DD1 corresponding to the first display area DA1 is determined based on the representative gray-scale value GRE (S140). This determination includes three steps, S141, S142, and S143, described below.

To determine the dimming function DDD, a target brightness value TGV corresponding to the representative gray-scale value GRE is extracted using a target gamma curve (S141). The target gamma curve is a curve that indicates the relation between the gray-scale values and ideal brightness values corresponding to the gray-scale values.

After that, a light-emitting brightness value LGV of the light sources is calculated using the target brightness value TGV (S142). The light-emitting brightness value LGV indicates a brightness value in the first display area DA1, which is caused by the light emitted from the light sources included in the first dimming area DD1. The light-emitting brightness value LGV may be calculated from the target brightness value TGV by consideration of influences from the light sources included in the second dimming area RD1:CD2 and fifth dimming area RD2:CD1 adjacent to the first dimming area DD1, and possibly the sixth dimming area RD2:CD2 diagonal to the first dimming area DD1. For example, the light-emitting brightness value LGV may be calculated from the target brightness value TGV using a point spread function.

The dimming function DDD of the light sources included in the first dimming area DD1 may be determined corresponding to the light-emitting brightness value LGV (S143).

Then, the light sources in the first dimming area DD1 may be driven on the basis of the determined dimming function DDD (S150).

In addition, the backlight unit 150 may include light sources displaying various colors, for example, red light sources, green light sources, blue light sources, and representative gray-scale values may be extracted from each light source since the representative gray-scale values and the target gamma curve may differ based on the color of the light sources.

Thus, when extracting the gray-scale values GRV, a plurality of red gray-scale values is extracted from red image signals corresponding to the first display area DA1 to calculate an average value of the red gray-scale values, a plurality of green gray-scale values is extracted from green image signals corresponding to the first display area DA1 to calculate an average value of the green gray-scale values, and a plurality of blue gray-scale values is extracted from blue image signals corresponding to the first display area DA1 to calculate an average value of the blue gray-scale values.

Then, at least one of the variance, standard deviation, kurtosis, skewness, central moment, and image moment is calculated using the average value of the red gray-scale values, at least one of the variance, standard deviation, kurtosis, skewness, central moment, and image moment is calculated using the average value of the green gray-scale values, and at least one of the variance, standard deviation, kurtosis, skewness, central moment, and image moment is calculated using the average value of the blue gray-scale values.

After that, a red representative gray-scale value corresponding to the first display area DA1 is determined using the calculated values from the red gray-scale values, a green representative gray-scale value corresponding to the first display area DA1 is determined using the calculated values from the green gray-scale values, and a blue representative gray-scale value corresponding to the first display area DA1 is determined using the calculated values from the blue gray-scale values.

Then, a red dimming function of the red light sources in the first dimming area DD1 is determined using the red representative gray-scale value, a green dimming function of the green light sources in the first dimming area DD1 is determined using the green representative gray-scale value, and a blue dimming function of the blue light sources in the first dimming area DD1 is determined using the blue representative gray-scale value.

The red light sources in the first dimming area DD1 are driven based on the red dimming function, the green light sources in the first dimming area DD1 are driven based on the green dimming function, and the blue light sources in the first dimming area DD1 are driven based on the blue dimming function.

The above-mentioned representative gray-scale values have been determined using the average value of the gray-scale values, but it should not be limited thereto or thereby. That is, the representative gray-scale value may be determined using a median value or a mode value instead of the average value. In detail, the average value is used generally to calculate the kurtosis, skewness, variance, standard deviation, central moment, or image moment, but the average value may be replaced with the median value or the mode value. For example, the variance $\sigma^2_f$ using the mode value $P_f$ may be defined by the following functional formula.

$$\sigma_f^2 = \frac{1}{n}\sum_{i=1}^{n}(I_i - P_f)^2 \qquad \text{Functional formula 11}$$

Figure 5:
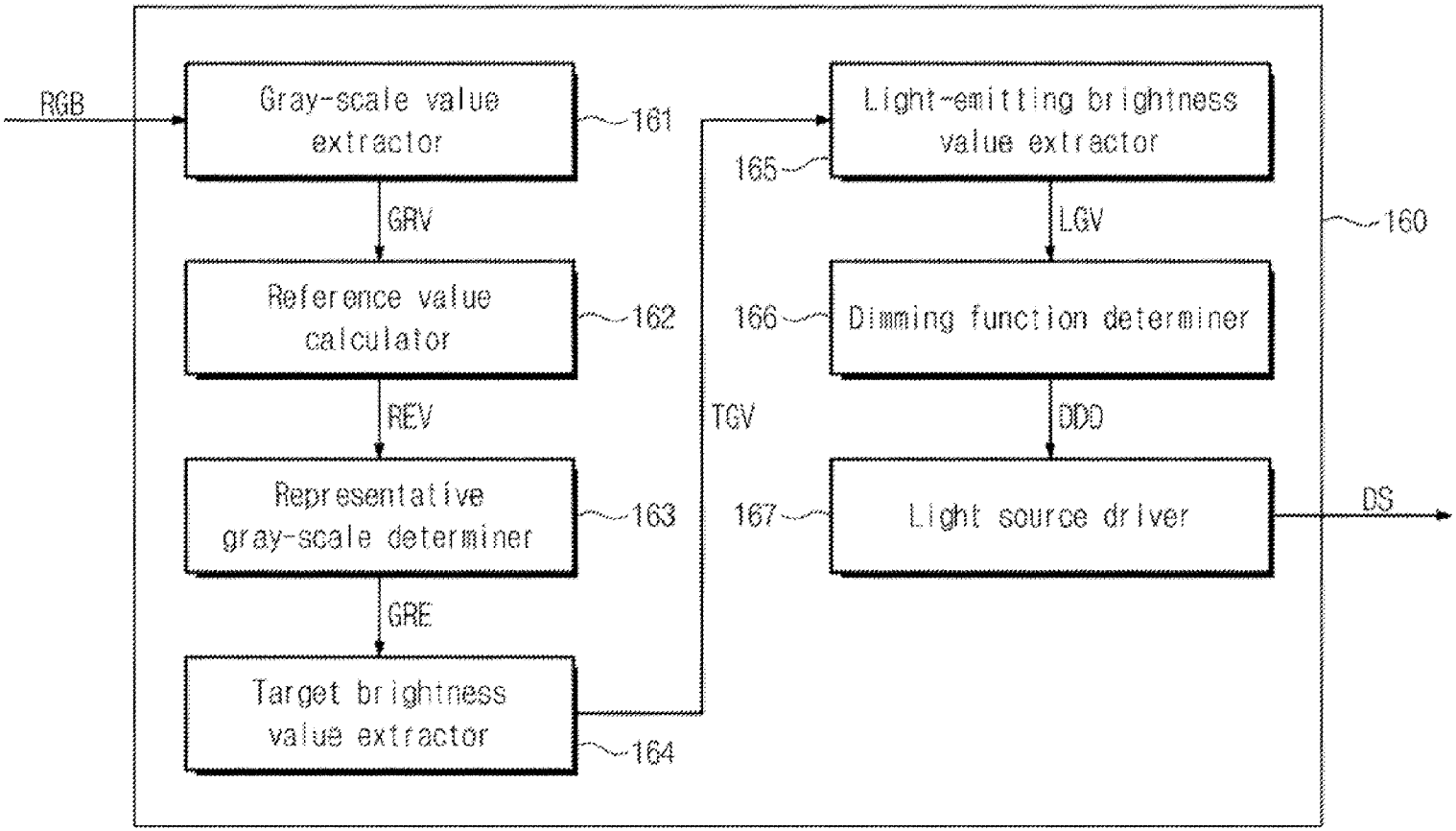
FIG. 5 is a block diagram of a backlight control circuit of FIG. 1.

FIG. 5 is a block diagram showing a backlight control circuit of FIG. 1. For the convenience of explanation, the first dimming area DD1 and the first display area DA1 of FIG. 2 will be described.

Referring to FIG. 5, the backlight control circuit 160 includes a gray-scale value extractor 161, a reference value calculator 162, a representative gray-scale determiner 163, a target brightness value extractor 164, a light-emitting brightness value extractor 165, a dimming function determiner 166, and a light source driver 167.

The gray-scale value extractor 161 receives the image signal RGB and extracts the gray-scale values GRV from the image signals corresponding to the first display area DD1 among the image signals RGB. According to an embodiment of the invention, the gray-scale extractor 161 receives the data control signal DCS from the timing controller 120 to extract the gray-scales GRV from the image signals corresponding to the first display area DD1.

The reference value calculator 162 receives the gray-scale values GRV and calculates the reference values REV, such as the mean value, variance, standard deviation, kurtosis, skewness, central moment, or image moment, used to determine the representative gray-scale value GRE of the first display area DA1.

The representative gray-scale value extractor 163 receives the reference values REV and determines the representative gray-scale value GRE corresponding to the first display area DA1 using a predetermined method according to an embodiment of the invention or the predetermined functional formulae.

The target brightness value extractor 164 receives the representative gray-scale value GRE and extracts the target brightness value TGV corresponding to the representative gray-scale GRE using the target gamma curve. According to an embodiment of the invention, the target brightness value extractor 164 may include a look-up table (not shown) in which target gamma data corresponding to the target gamma curve are stored.

The light-emitting brightness value extractor 165 receives the target brightness value TGV and extracts the light-emitting brightness value LGV of the light sources included in the first dimming area DD1 using the target brightness value TGV.

The dimming function determiner 166 receives the light-emitting brightness values LGV and determines the dimming function DDD of the light sources in the first dimming area DD1.

The light source driver 167 outputs the dimming signal DS based on the dimming function DDD to drive the backlight unit 150.

Although the exemplary embodiments of the present invention have been described, it is understood that embodiments of the present invention should not be limited to these exemplary embodiments but various changes and modifications can be made by one of ordinary skill in the art within the spirit and scope of the embodiments of the present invention as hereinafter claimed.

What is claimed is:

1. A method of dimming a backlight assembly of a display panel comprising a plurality of light sources divided into at least one dimming area, the method comprising:

providing image signals to the display panel;

extracting a plurality of gray-scale values from image signals corresponding to the dimming area to calculate a location parameter value of the gray-scale values;

calculating a kurtosis and a skewness using the location parameter value to output the kurtosis and the skewness as a first calculated value;

calculating at least one of a variance, a standard deviation, a central moment, and an image moment using the location parameter value to output at least one of the variance, the standard deviation, the central moment, and the image moment as a second calculated value;

calculating a maximum value of the gray-scale values;

determining a representative gray-scale value corresponding to the dimming area using the first and the second calculated values;

determining a dimming function for the light sources included in the dimming area based on the representative gray-scale value; and driving the light sources included in the dimming area based on the dimming function, wherein the representative gray-scale value GRE is represented by the following formula:

$$\gamma_2 \geq 0, GRE = \alpha \times m + (1-\alpha) \times P,$$

$$\gamma_2 < 0, GRE = \alpha \times m + (1-\alpha) \times P - \beta\gamma_1,$$

wherein m denotes the location parameter value, P denotes the maximum value, $\gamma_1$ denotes the kurtosis, $\gamma_2$ denotes the skewness, $$\alpha = \frac{1}{C+K}$$

and $\beta$ are predetermined constants,

C is a predetermined constant satisfying $0.5 \leq C \leq 1.5$,

K is $\mathrm{Max}(|\bar{x}|, |\bar{y}|, \sqrt{|\mu_{ij}|})$ if $$\mathrm{Max}(\sqrt{|\mu_{20}|}, \sqrt{|\mu_{02}|}, \sqrt[3]{|\mu_{12}|}, \sqrt[3]{|\mu_{21}|}, \sqrt[3]{|\mu_{30}|}, \sqrt[3]{|\mu_{03}|}) \geq T$$

and zero (0) if $$\mathrm{Max}(\sqrt{|\mu_{20}|}, \sqrt{|\mu_{02}|}, \sqrt[3]{|\mu_{12}|}, \sqrt[3]{|\mu_{21}|}, \sqrt[3]{|\mu_{30}|}, \sqrt[3]{|\mu_{03}|}) < T,$$

T denotes a predetermined threshold value, $\bar{x}$ denotes an x-axis average raw image moment of the gray-scale values, $\bar{y}$ denotes a y-axis average raw image moment of the gray-scale values, and $\mu_{ij}$ denotes a central image moment of an i-th degree along the x-axis and of a j-th degree along the y-axis.

2. The method of claim 1, wherein determining the dimming function comprises:

extracting a target brightness value corresponding to the representative gray-scale value using a target gamma curve;

extracting a light-emitting brightness value of the light sources using the target brightness value; and determining the dimming function for the light sources included in the dimming area in response to the light-emitting brightness value.

3. The method of claim 1, wherein the image moment comprises a raw image moment of an n-th degree or lower and a central image moment of the n-th degree or lower, where n is a number of the gray-scale values.

4. The method of claim 1, wherein the location parameter is one of a mean, a median, or a mode.

5. A method of dimming a backlight assembly of a display panel comprising a plurality of light sources divided into at least one dimming area, the method comprising:

providing image signals to the display panel;

extracting a plurality of gray-scale values from image signals corresponding to the dimming area to calculate a location parameter value of the gray-scale values;

calculating a kurtosis and a skewness using the location parameter value to output the kurtosis and the skewness as a first calculated value;

calculating at least one of a variance, a standard deviation, a central moment, and an image moment using the location parameter value to output at least one of the variance, the standard deviation, the central moment, and the image moment as a second calculated value;

determining a representative gray-scale value corresponding to the dimming area using the first and the second calculated values;

determining a dimming function for the light sources included in the dimming area based on the representative gray-scale value; and driving the light sources included in the dimming area based on the dimming function, wherein the representative gray-scale value GRE is represented by the following formula:

$$\gamma_1 \geq 0, GRE = m - K\frac{\sigma + \gamma_2}{2},$$

$$\gamma_1 < 0, GRE = m + K\frac{\sigma + \gamma_2}{2},$$

wherein m denotes the location parameter value, $\sigma$ denotes the variance, $\gamma_1$ denotes the kurtosis, $\gamma_2$ denotes the skewness, and K is a predetermined constant satisfying $K>0$.

6. The method of claim 5, further comprising calculating a minimum value or a maximum value of the gray-scale values.

7. The method of claim 5, wherein determining the dimming function comprises:

extracting a target brightness value corresponding to the representative gray-scale value using a target gamma curve;

extracting a light-emitting brightness value of the light sources using the target brightness value; and determining the dimming function for the light sources included in the dimming area in response to the light-emitting brightness value.

8. The method of claim 5, wherein the image moment comprises a raw image moment of an n-th degree or lower and a central image moment of the n-th degree or lower, where n is a number of the gray-scale values.

9. The method of claim 5, wherein the location parameter is one of a mean, a median, or a mode.

10. A method of dimming a backlight assembly of a display panel comprising a plurality of light sources divided into at least one dimming area, the method comprising:

providing image signals to the display panel;

extracting a plurality of gray-scale values from image signals corresponding to the dimming area to calculate a location parameter value of the gray-scale values;

calculating a kurtosis and a skewness using the location parameter value to output the kurtosis and the skewness as a first calculated value;

calculating at least one of a variance, a standard deviation, a central moment, and an image moment using the location parameter value to output at least one of the variance, the standard deviation, the central moment, and the image moment as a second calculated value;

calculating a maximum value of the gray-scale values;

determining a representative gray-scale value corresponding to the dimming area using the first and the second calculated values;

determining a dimming function for the light sources included in the dimming area based on the representative gray-scale value; and driving the light sources included in the dimming area based on the dimming function, wherein the representative gray-scale value GRE is represented by the following formula:

$$GRE = \alpha_1 m + \alpha_2 \sigma + \alpha_3 \gamma_1 + \alpha_4 \gamma_2 + \alpha_5 P + \alpha_6 \bar{x} + \alpha_7 \bar{y} + \alpha_8 \sqrt{|\mu_{11}|} + \alpha_9 \sqrt{|\mu_{20}|} + \alpha_{10} \sqrt{|\mu_{02}|} + \alpha_{11} \sqrt[3]{|\mu_{12}|} + \alpha_{12} \sqrt[3]{|\mu_{21}|} + \alpha_{13} \sqrt[3]{|\mu_{30}|} + \alpha_{14} \sqrt[3]{|\mu_{03}|},$$

wherein m denotes the location parameter value, $\sigma$ denotes the variance,

P denotes the maximum value, $\gamma_1$ denotes the kurtosis, $\gamma_2$ denotes the skewness, $\bar{x}$ denotes an x-axis average raw image moment of the gray-scale values, $\bar{y}$ denotes a y-axis average raw image moment of the gray-scale values, and $\mu_{ij}$ denotes a central image moment of an i-th degree along the x-axis and of a j-th degree along the y-axis, and if $\alpha_1+\alpha_2+\alpha_3+\alpha_4+\alpha_5+\alpha_6+\alpha_7+\alpha_8+\alpha_9+\alpha_{10}+\alpha_{11}+\alpha_{12}+\alpha_{13}+\alpha_{14}$ is 1, then each $\alpha_i$ is greater than or equal to zero (0) and less than or equal to one (1) ($0 \le \alpha_i \le 1$).

11. The method of claim 10, wherein determining the dimming function comprises:

extracting a target brightness value corresponding to the representative gray-scale value using a target gamma curve;

extracting a light-emitting brightness value of the light sources using the target brightness value; and determining the dimming function for the light sources included in the dimming area in response to the light-emitting brightness value.

12. The method of claim 10, wherein the image moment comprises a raw image moment of an n-th degree or lower and a central image moment of the n-th degree or lower, where n is a number of the gray-scale values.

13. The method of claim 10, wherein the location parameter is one of a mean, a median, or a mode.

14. A method of dimming a backlight assembly of a display panel comprising a plurality of light sources divided into at least one dimming area, the method comprising:

providing image signals to the display panel;

extracting a plurality of gray-scale values from image signals corresponding to the dimming area to calculate a location parameter value of the gray-scale values;

calculating a kurtosis and a skewness using the location parameter value to output the kurtosis and the skewness as a first calculated value;

calculating at least one of a variance, a standard deviation, a central moment, and an image moment using the location parameter value to output at least one of the variance, the standard deviation, the central moment, and the image moment as a second calculated value;

calculating a maximum value of the gray-scale values;

determining a representative gray-scale value corresponding to the dimming area using the first and the second calculated values;

determining a dimming function for the light sources included in the dimming area based on the representative gray-scale value; and driving the light sources included in the dimming area based on the dimming function, wherein the representative gray-scale value GRE is represented by the following formula:

$$A \le T_1, GRE = m,$$

$$A \ge T_2, GRE = P,$$

wherein when A is greater than $T_1$ and less than $T_2$ ($T_1 < A < T_2$), the representative gray-scale value satisfies $GRE = \alpha \times m + (1-\alpha) \times P$ when the kurtosis $\gamma_1$ is greater than zero ($\gamma_1 > 0$), the representative gray-scale value satisfies $GRE = (1-\beta) \times m + \beta \times P$ when the kurtosis $\gamma_1$ is equal to or smaller than zero ($\gamma_1 \le 0$), wherein $$A = |\bar{x}| + |\bar{y}| + \sqrt{|\mu_{ij}|},$$

$\bar{x}$ denotes an x-axis average raw image moment of the gray-scale values, $\bar{y}$ denotes a y-axis average raw image moment of the gray-scale values, $\mu_{ij}$ denotes a central image moment of an i-th degree along the x-axis and of a j-th degree along the y-axis, m denotes the location parameter value, P denotes the maximum value, $\gamma_1$ denotes the kurtosis, $\gamma_2$ denotes the skewness, $T_1$ and $T_2$ are predetermined threshold values, $\alpha = K\gamma_1\gamma_2$, $\beta = -K\gamma_1\gamma_2$, and K denotes a predetermined constant.

15. The method of claim 14, wherein determining the dimming function comprises:

extracting a target brightness value corresponding to the representative gray-scale value using a target gamma curve;

extracting a light-emitting brightness value of the light sources using the target brightness value; and determining the dimming function for the light sources included in the dimming area in response to the light-emitting brightness value.

16. The method of claim 14, wherein the image moment comprises a raw image moment of an n-th degree or lower and a central image moment of the n-th degree or lower, where n is a number of the gray-scale values.

17. The method of claim 14, wherein the location parameter is one of a mean, a median, or a mode.

* * * * *